US010814177B1

(12) United States Patent
Madson et al.

(10) Patent No.: US 10,814,177 B1
(45) Date of Patent: Oct. 27, 2020

(54) GOLF BALL DIMPLE SHAPE

(71) Applicant: Acushnet Company, Fairhaven, MA (US)

(72) Inventors: Michael R. Madson, Easton, MA (US); Emilia DaCosta, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/423,433

(22) Filed: May 28, 2019

(51) Int. Cl.
*A63B 37/12* (2006.01)
*A63B 37/00* (2006.01)

(52) U.S. Cl.
CPC ..... *A63B 37/0009* (2013.01); *A63B 37/0016* (2013.01); *A63B 37/0019* (2013.01); *A63B 37/0012* (2013.01)

(58) Field of Classification Search
CPC ..... A63B 37/0007; A63B 37/0012
USPC ..... 473/383–384
See application file for complete search history.

(56) References Cited

U.S. PATENT DOCUMENTS

| | | | |
|---|---|---|---|
| 8,403,775 | B2 | 3/2013 | Aoyama |
| 2005/0266934 | A1 | 12/2005 | Morgan et al. |
| 2011/0111887 | A1 | 5/2011 | Sullivan et al. |
| 2017/0050083 | A1 | 2/2017 | Madson et al. |
| 2017/0182365 | A1 | 6/2017 | Madson et al. |
| 2019/0015707 | A1 | 1/2019 | Madson et al. |

*Primary Examiner* — Raeann Gorden
(74) *Attorney, Agent, or Firm* — Margaret C. Barker

(57) ABSTRACT

The present invention is directed to golf balls having improved aesthetics and desirable aerodynamic properties due, at least in part, to the novel shape of the dimples on the surface thereof. In particular, the present invention is directed to a golf ball that includes at least a portion of its dimples having a shape obtained from the intersection of a prismatic polyhedron and the golf ball outer surface. The resulting curve of intersection represents the dimple perimeter and the intersecting portion of the surface of the prismatic polyhedron represents the dimple surface shape.

11 Claims, 11 Drawing Sheets

GOLF BALL DIMPLE SHAPE

FIELD OF THE INVENTION

The present invention relates to golf ball dimples having a novel shape obtained from the intersection of a prism and a sphere. Alternatively, a novel shape obtained from the intersection of at least two planar surfaces and a common edge thereof with the sphere.

BACKGROUND OF THE INVENTION

Dimples on the outer surface of golf balls are known to have a significant effect on the aerodynamic forces acting on the ball during flight. For example, the dimples on a golf ball create a turbulent boundary layer around the ball. The turbulence energizes the boundary layer and helps it stay attached further around the ball to reduce the area of the wake. This greatly increases the pressure behind the ball and substantially reduces the drag. Dimples also contribute to the overall aesthetic appearance of the ball. Based on the role that dimples play in aesthetics and aerodynamic characteristics of golf balls, golf ball manufacturers continually seek to develop novel dimple patterns, sizes, plan shapes, volumes, cross-sections, etc., as compared with circular plan shapes, which are infinitely symmetric about a normal axis. Thus, the present invention is directed to a golf ball having uniquely shaped dimples that provide the ball with enhanced aesthetics and unique aerodynamic properties.

SUMMARY OF THE INVENTION

A golf ball of the invention has a generally spherical surface and comprises a plurality of dimples on the spherical surface, including at least one dimple having a dimple perimeter defined by a curve of intersection resulting from the intersection of a prism with the spherical surface of the golf ball; and a surface shape defined by the portion of the prismatic outer surface that intersects with the spherical surface of the golf ball. The prismatic outer surface includes two parallel and congruent n-sided polygonal bases and at least three side faces, wherein each side face is adjacent to two other side faces and is adjoined to one side of each polygonal base; and wherein the portion of the prismatic outer surface that intersects with the spherical surface of the golf ball includes at least two adjacent side faces and does not include any portion of the polygonal bases.

In one embodiment, the dimple perimeter is not axially symmetric when viewed in the direction normal to an axis connecting the center of the ball to the centroid of the dimple.

In one embodiment, the prism is a regular prism. In another embodiment, the prism is an irregular prism.

In some embodiments, the prism is a right prism. In other embodiments, the prism is an oblique prism.

In particular embodiments, each of the two polygonal bases has ten or fewer sides.

In a specific embodiment, the at least one dimple has a surface depth SD of no greater than 0.020 inches. In another specific embodiment, a distance $L_E$ between two points at which the prism and the sphere intersect is from 0.050 inches to 0.400 inches.

In one particular embodiment, each dimple of the portion has a plan shape area within a range having a lower limit of about 0.002 in.$^2$ and an upper limit of about 0.045 in.$^2$; and a dimple surface volume within a range having a lower limit of about $0.1^{\times 10-4}$ in.$^3$ and an upper limit of about $4.3^{\times 10-4}$ in.$^3$. In a specific such embodiment, each dimple of the portion has a plan shape area within a range having a lower limit of from about 0.006 in.$^2$ and an upper limit of about 0.032 in.$^2$; and a dimple surface volume within a range having a lower limit of about $0.2^{\times 10-4}$ in.$^3$ and an upper limit of about $2.1^{\times 10-4}$ in.$^3$.

BRIEF DESCRIPTION OF THE DRAWINGS

In the accompanying drawings, which form a part of the specification and are to be read in conjunction therewith, and which are given by way of illustration only, and thus are not meant to limit the present invention.

DETAILED DESCRIPTION

Figure 1A:
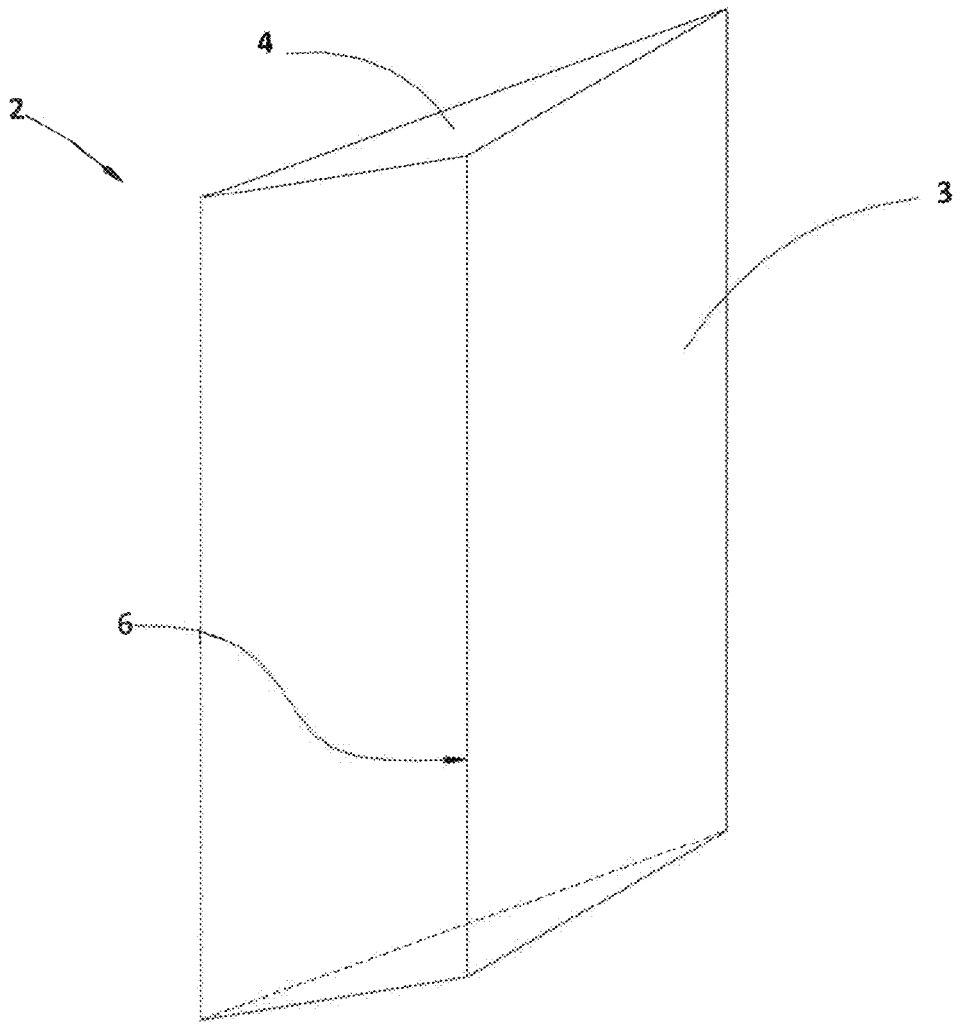
FIG. 1A illustrates a perspective view of an irregular triangular prism according to an embodiment of the present invention.

The present invention is directed to golf balls having improved aesthetics and desirable aerodynamic properties due, at least in part, to the use of dimples having a novel shape and boundary resulting from the intersection of a prismatic polyhedron and a spherical body, the spherical body representing the golf ball.

A golf ball of the invention has a generally spherical surface and comprises a plurality of dimples on the spherical surface, including at least one dimple having a dimple perimeter defined by a curve of intersection resulting from the intersection of a prism with the spherical surface of the golf ball; and a surface shape defined by the portion of the prismatic outer surface that intersects with the spherical surface of the golf ball. The prismatic outer surface includes two parallel and congruent n-sided polygonal bases and at least three side faces, wherein each side face is adjacent to two other side faces and is adjoined to one side of each polygonal base; and wherein the portion of the prismatic outer surface that intersects with the spherical surface of the golf ball includes at least two adjacent side faces and does not include any portion of the polygonal bases.

Herein, the terms "prismatic polyhedron" and "prism" are used interchangeably to refer to a polyhedron comprising an n-sided polygonal base wherein n>3, a second base which is a translated copy (rigidly moved without rotation) of the first, and n other side faces (necessarily all parallelograms) joining corresponding sides of the two bases. All cross-sections parallel to the bases are translations of the bases. Since prisms are named for their bases, a prism with a triangularly-shaped base (and therefore having three side faces) is called a triangular prism. Prisms are a subclass of the prismatoids (i.e., a polyhedron whose vertices all lie in two parallel planes) and have bases and side faces that are flat.

In particular embodiments, each of the two polygonal bases has ten or fewer sides. Examples of suitable prisms include triangular prisms, rectangular prisms, pentagonal prisms, hexagonal prisms, heptagonal prisms, octagonal prisms, and/or decagonal prisms.

The resulting curve of intersection between the golf ball outer surface and the prism intersecting it represents the dimple perimeter. And the dimple surface shape is defined by the outwardly facing portion of the prismatic polyhedron outer surface intersecting with the sphere outer surface of the golf ball. The resulting dimple volume is therefore the space enclosed within the dimple surface shape and the portion of the spherical surface within the dimple perimeter.

Every given prism used to intersect the golf ball outer surface and create a dimple has a total volume V=Bh, wherein B is the area of each prism base, and h is the length of each side face extending between the prism's two bases. However, only a portion of this total volume V intersects the outer surface of the golf ball and creates the dimple's perimeter and surface contour. In this regard, the values of B and h should be coordinated to ensure that the prism bases do not intersect the golf ball outer surface.

Base area B may be calculated using the equation typically applied for the polygon shape of a given prism's base. For example, where the prism has an irregular triangularly-shaped base, B can be calculated using the equation B=½ b (length of base of the triangle)*$h_b$ (height of the triangularly shaped base). In turn, where the prism has hexagonally-shaped bases, B can be calculated using the equation B=((3√3)/2)(length of a side of the hexagonal base, squared)).

In one embodiment, the dimple perimeter is not axially symmetric when viewed in the direction normal to an axis connecting the center of the ball to the centroid of the dimple.

In one embodiment, the prism is a regular prism. In another embodiment, the prism is an irregular prism.

In some embodiments, the prism is a right prism. In other embodiments, the prism is an oblique prism.

In particular embodiments, each of the two polygonal bases has 10 or fewer sides.

In a specific embodiment, the at least one dimple meanwhile has a surface depth SD of no greater than 0.020 inches. The dimple's surface depth, SD, is the distance measured along a golf ball radius from a phantom surface of the golf ball to the deepest point on the dimple, wherein the phantom surface is drawn above the dimple as a continuation of the land surface of the golf ball (which is the portion of the golf ball's outer surface between dimples).

In another specific embodiment, a distance $L_E$ between two points at which the prism and the sphere intersect is from 0.050 inches to 0.400 inches. Herein, distance $L_E$ is a widest portion of the resulting dimple as between points along the resulting dimple's perimeter and is determined by measuring the length of the line extending between each prism edge's two points of intersection with the spherical surface of the golf ball.

In one particular embodiment, each dimple of the portion has a plan shape area within a range having a lower limit of about 0.002 in.$^2$ and an upper limit of about 0.045 in.$^2$; and a dimple surface volume within a range having a lower limit of about $0.1^{\times 10-4}$ in.$^3$ and an upper limit of about $4.3^{\times 10-4}$ in.$^3$. In a specific such embodiment, each dimple of the portion has a plan shape area within a range having a lower limit of from about 0.006 in.$^2$ and an upper limit of about 0.032 in.$^2$; and a dimple surface volume within a range having a lower limit of about $0.2^{\times 10-4}$ in.$^3$ and an upper limit of about $2.1^{\times 10-4}$ in.$^3$.

Referring to the figures, FIG. 1A illustrates a perspective view of an irregular triangular prism 2, wherein three side faces 3 extend between two bases 4. Meanwhile, FIG. 1B illustrates a side view of the irregular triangular prism 2 depicted in FIG. 1A.

Figure 1B:
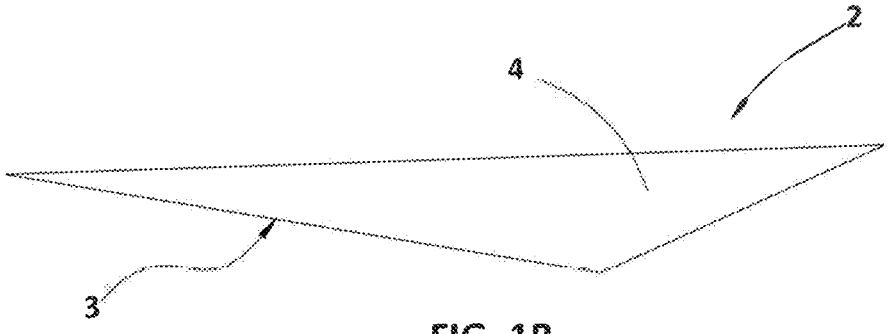
FIG. 1B illustrates a side view of the irregular triangular prism illustrated in FIG. 1A.
Figure 2A:
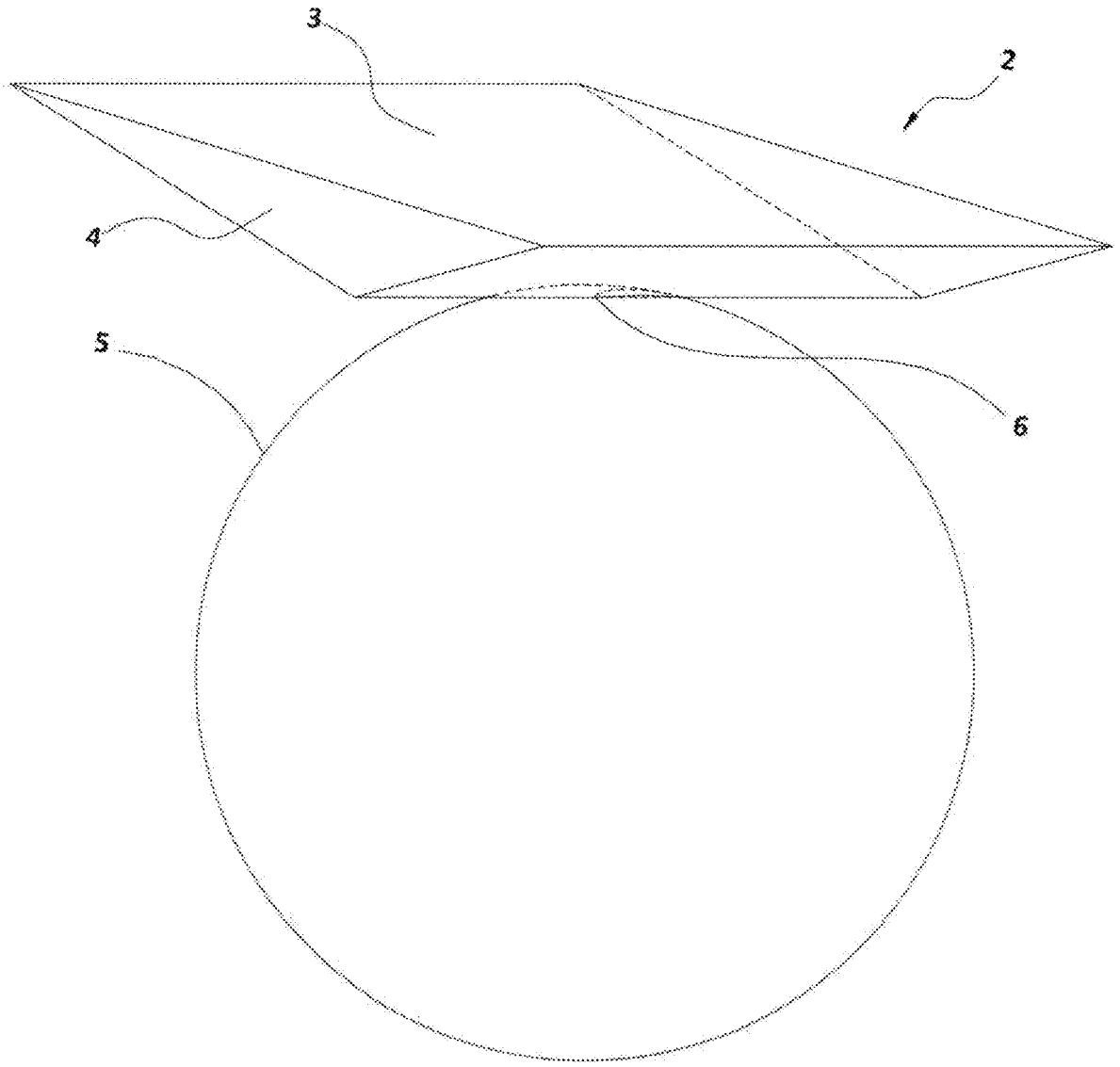
FIG. 2A illustrates an intersection of two solids (the irregular triangular prism of FIGS. 1A and 1B) intersecting with the spherical surface of a golf ball) according to an embodiment of the present invention.

FIG. 2A depicts a preferred embodiment wherein a prism such as irregular triangular prism 2 of FIGS. 1A and 1B intersects golf ball surface 5 at one or more edges 6 of prism 2 without bases 4 contacting golf ball surface 5. In every prism, the number of edges 6 is the same as the number of side faces 3 and are always located at an interface between each pair of adjacent side faces 3.

Figure 2B:
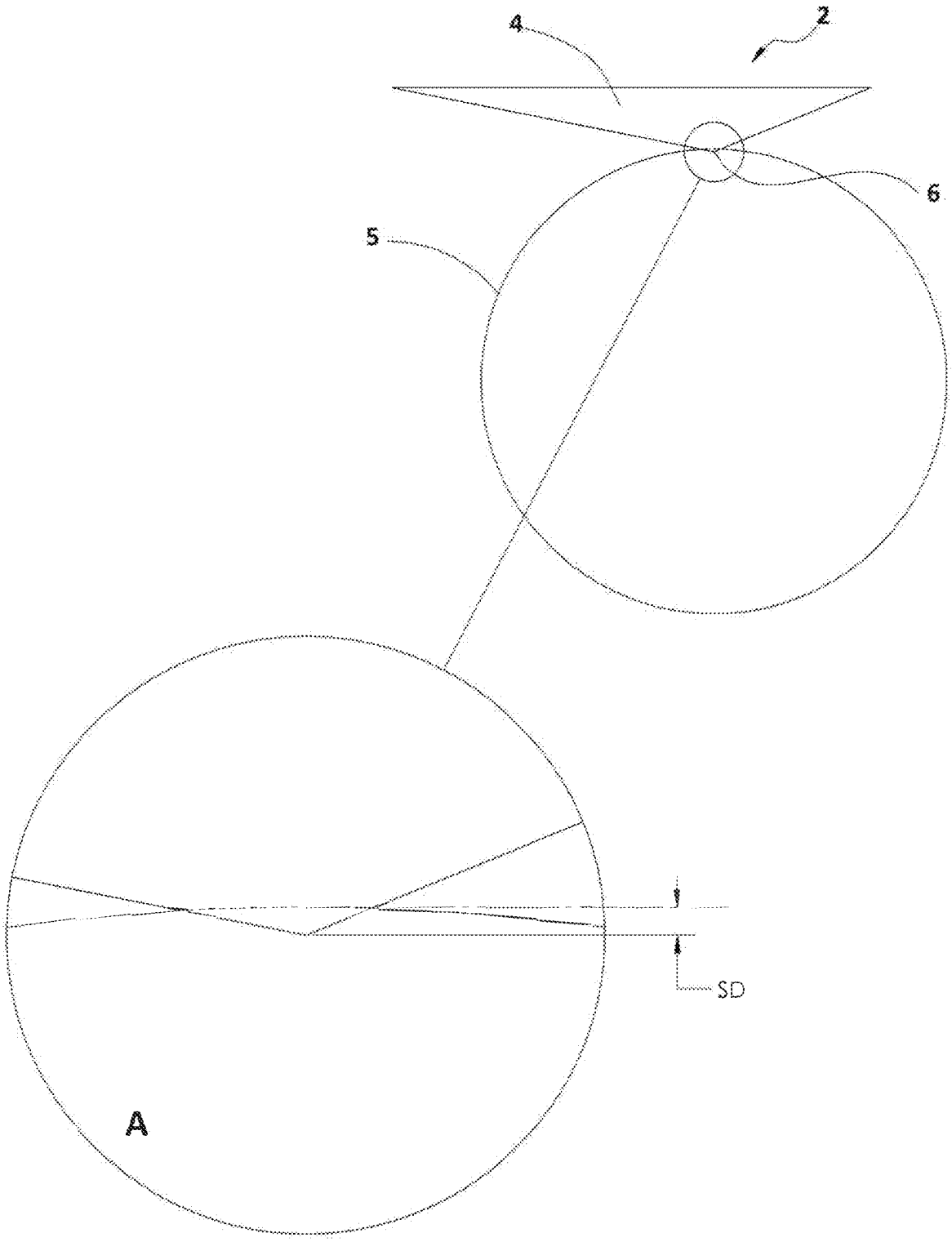
FIG. 2B illustrates a side view of an irregular triangular prism intersecting with the spherical surface of a golf ball, according to the embodiment of the present invention depicted in FIG. 2A, and includes an enlarged view A of the intersecting portion.
Figure 2C:
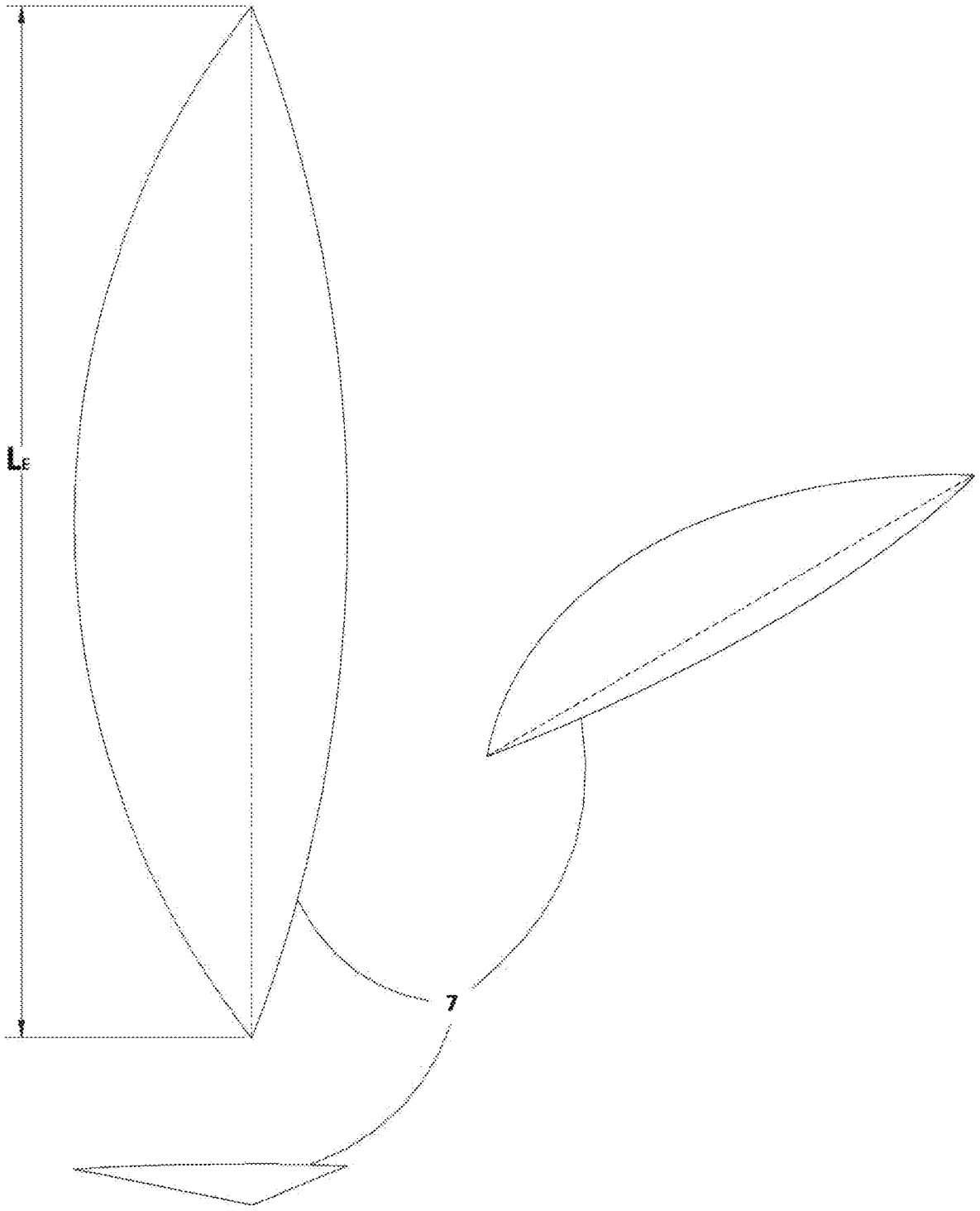
FIG. 2C illustrates plan, elevation and perspective views of the dimple resulting from an irregular triangular prism intersecting with the spherical surface of a golf ball, according to the embodiment of the present invention depicted in FIG. 2A.

FIG. 2B meanwhile depicts a view normal to base 4 of prism 2 (of FIG. 2A) intersecting golf ball surface 5 at one or more edges 6, with a detailed view A highlighting the surface depth SD of a dimple resulting from prism 2 intersecting outer surface 5. Meanwhile, FIG. 2C depicts plan, elevation, and perspective views of a dimple 7 resulting from prism 2 intersecting outer surface 5.

Figure 3A:
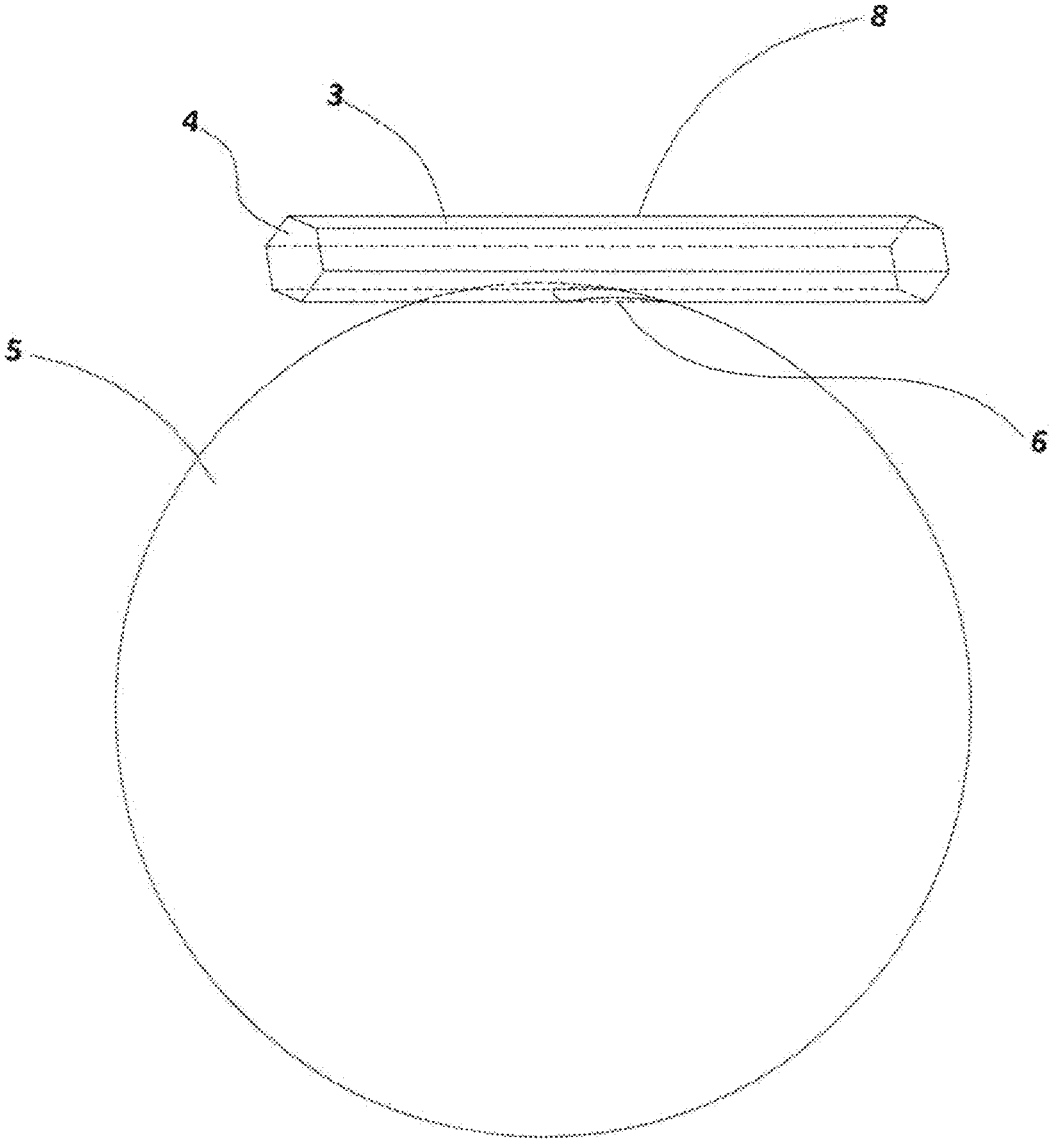
FIG. 3A illustrates an intersection of two solids (a regular hexagonal prism intersecting with the spherical surface of a golf ball) according to another embodiment of the present invention.
Figure 3B:
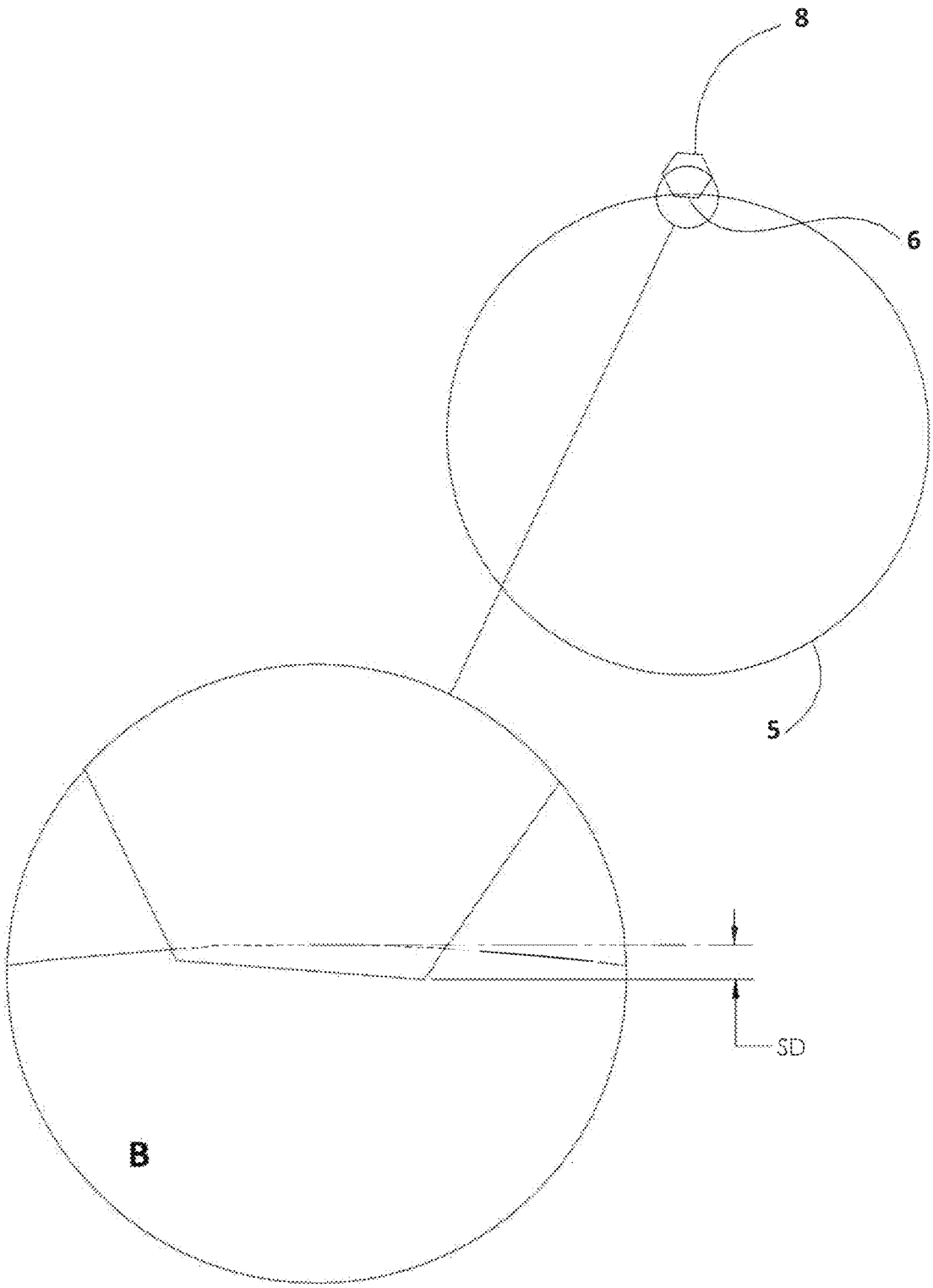
FIG. 3B illustrates a side view of a regular hexagonal prism intersecting with the spherical surface of a golf ball according to the embodiment of the present invention depicted in FIG. 3A, and includes an enlarged view B of the intersecting portion.
Figure 3C:
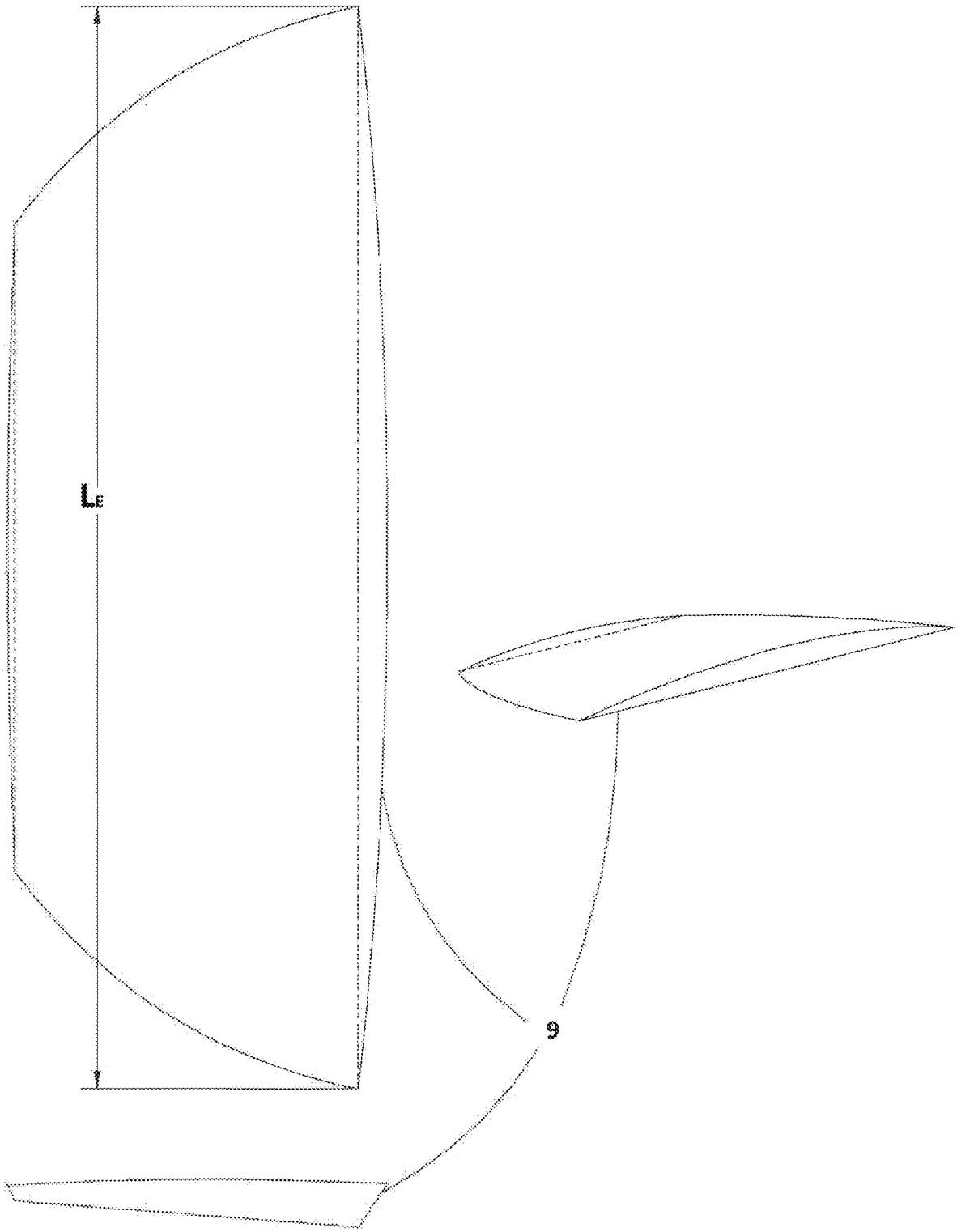
FIG. 3C illustrates plan, elevation and perspective views of the dimple resulting from a regular hexagonal prism intersecting with the spherical surface of a golf ball according to the embodiment of the present invention depicted in FIG. 3A.

FIGS. 3A, 3B, and 3C depict aspects of an embodiment wherein a regular hexagonal prism 8 intersects outer surface 5 of the golf ball. Specifically, in FIG. 3A, regular hexagonal prism 8 intersects golf ball surface 5 at one or more edges 6 of the prism 8 without bases 4 contacting golf ball surface 5. Once again, each edge 6 is located in prism 8 at an interface between each pair of adjacent side faces 3.

FIG. 3B meanwhile depicts a view normal to base 4 of prism 8 (of FIG. 3A) intersecting golf ball surface 5 at one or more edges 6, with a detailed view B highlighting the surface depth SD of a dimple resulting from prism 8 intersecting outer surface 5. Meanwhile, FIG. 3C depicts plan, elevation, and perspective views of a dimple 9 resulting from prism 8 intersecting outer surface 5.

Figure 4A:
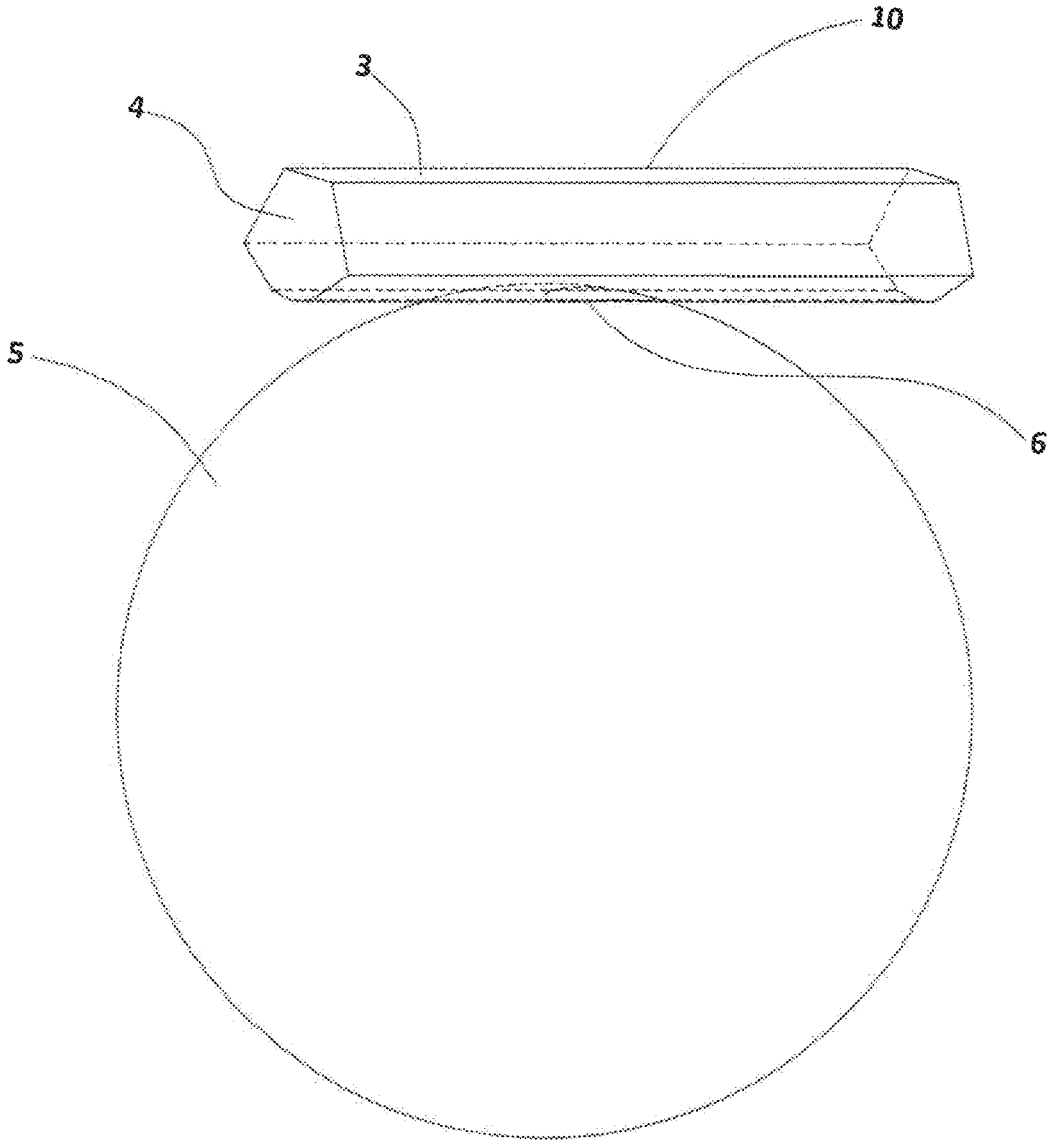
FIG. 4A illustrates an intersection of two solids (an irregular hexagonal prism intersecting with the spherical surface of a golf ball) according to yet another embodiment of the present invention.
Figure 4B:
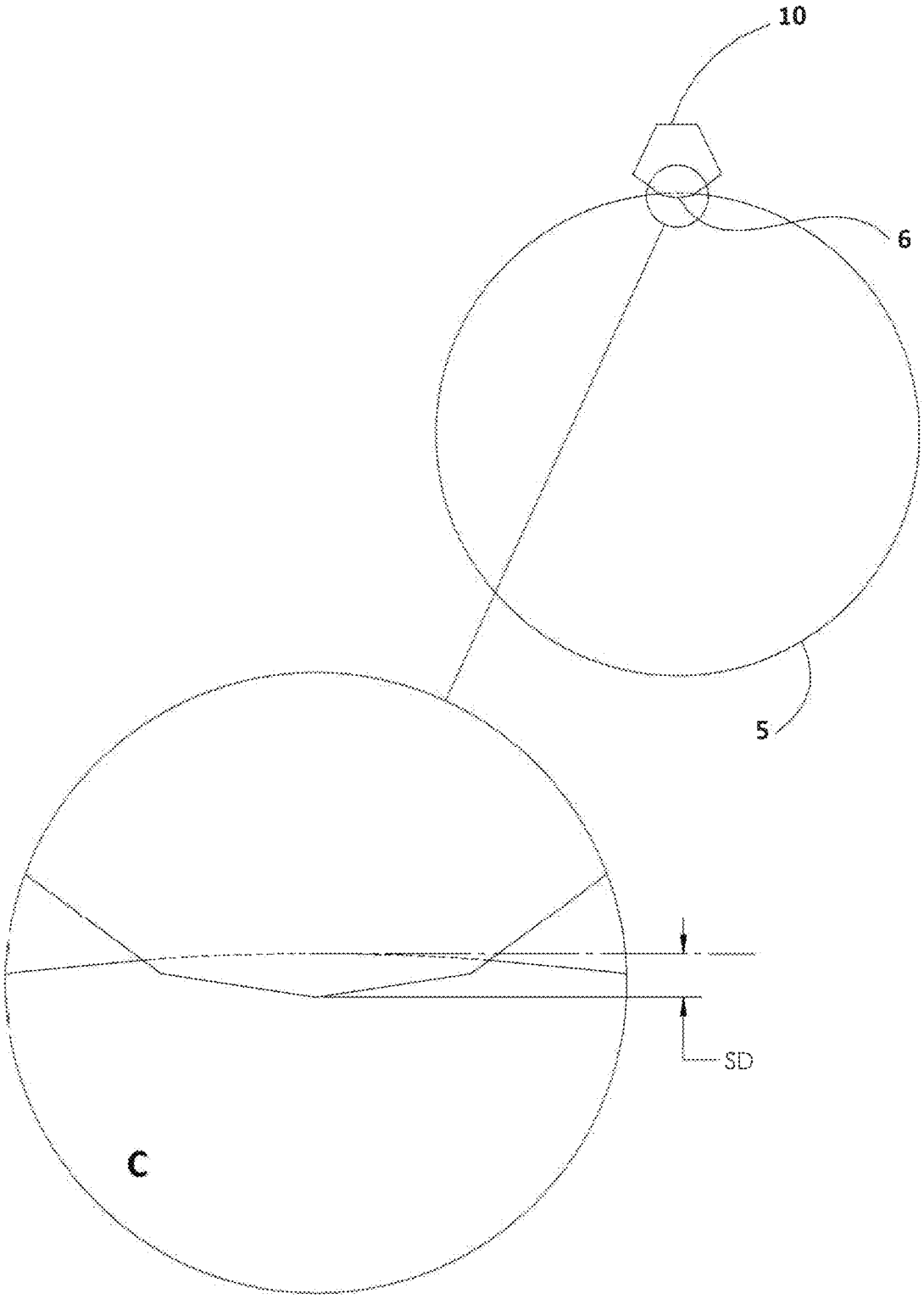
FIG. 4B illustrates a side view of an irregular hexagonal prism intersecting with the spherical surface of a golf ball according to the embodiment of the present invention depicted in FIG. 4A, and includes an enlarged view C of the intersecting portion.
Figure 4C:
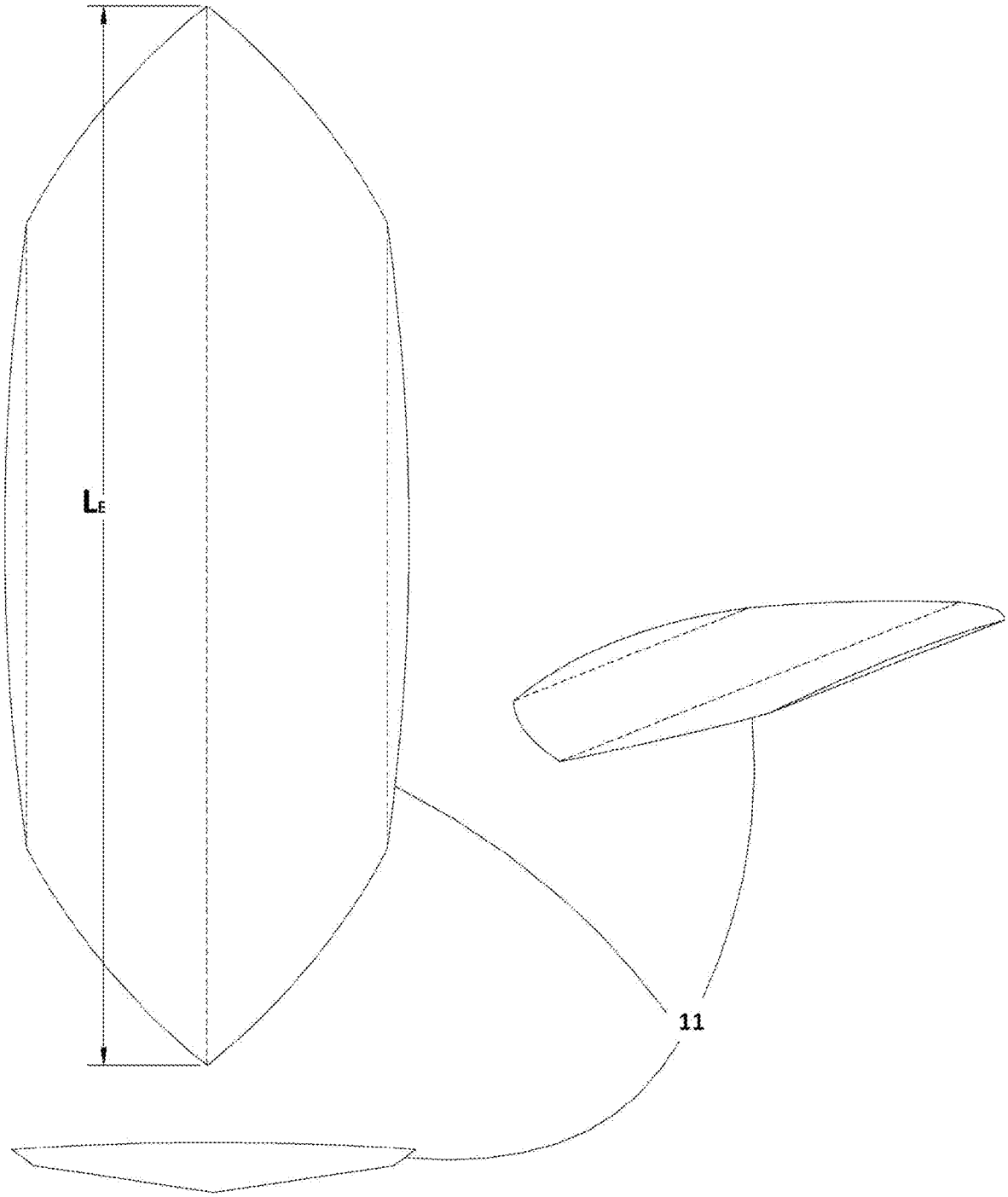
FIG. 4C illustrates plan, elevation and perspective views of the dimple resulting from an irregular hexagonal prism intersecting with the spherical surface of a golf ball, according to the embodiment of the present invention depicted in FIG. 4A.

Finally, FIGS. 4A, 4B, and 4C depict aspects of an embodiment wherein an irregular hexagonal prism 10 intersects outer surface 5 of the golf ball to create a dimple. Specifically, in FIG. 4A, irregular hexagonal prism 10 intersects golf ball surface 5 at one or more edges 6 of the prism 10 without bases 4 contacting golf ball surface 5. Once again, each edge 6 is located in prism 10 at an interface between each pair of adjacent side faces 3.

FIG. 4B meanwhile depicts a view normal to base 4 of prism 10 (of FIG. 4A) intersecting golf ball surface 5 at one or more edges 6, with a detailed view B highlighting the surface depth SD of a dimple resulting from prism 10 intersecting outer surface 5. Meanwhile, FIG. 4C depicts plan, elevation, and perspective views of a dimple 11 resulting from prism 10 intersecting outer surface 5.

Figure 5A:
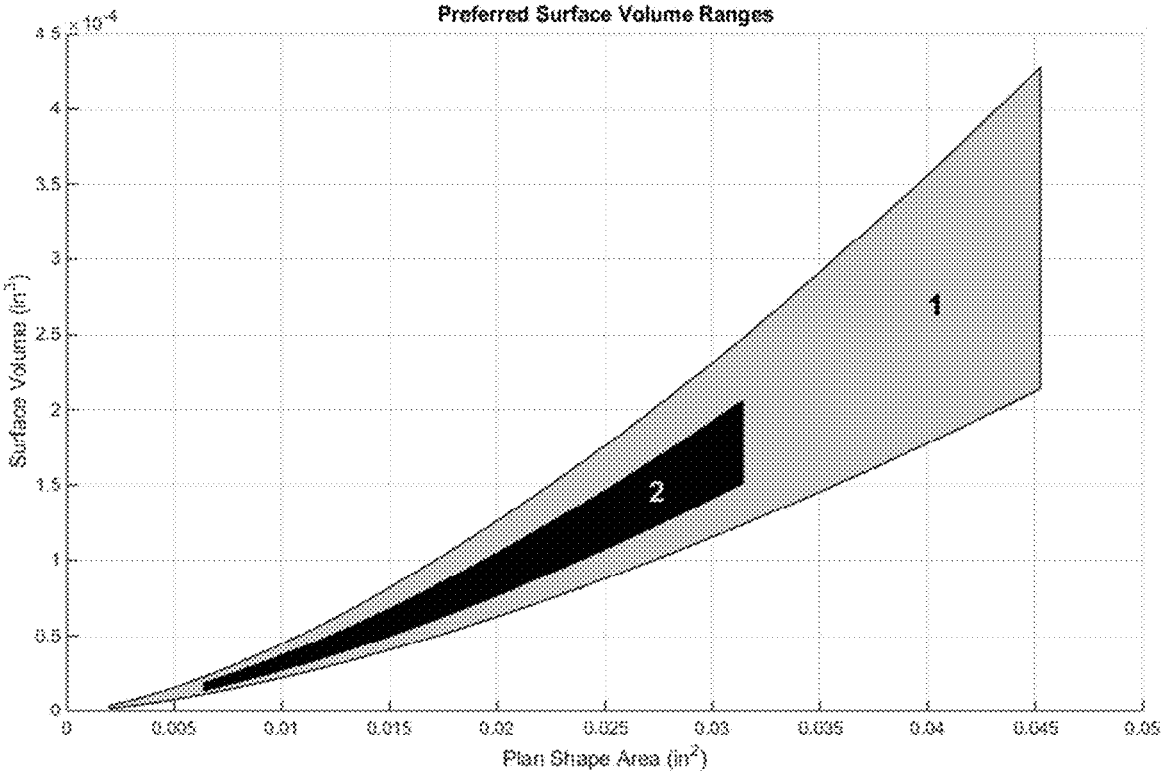
FIG. 5A is a graphical representation of preferred dimple surface volumes for the at least one dimples of golf balls of the invention.
Figure 5B:
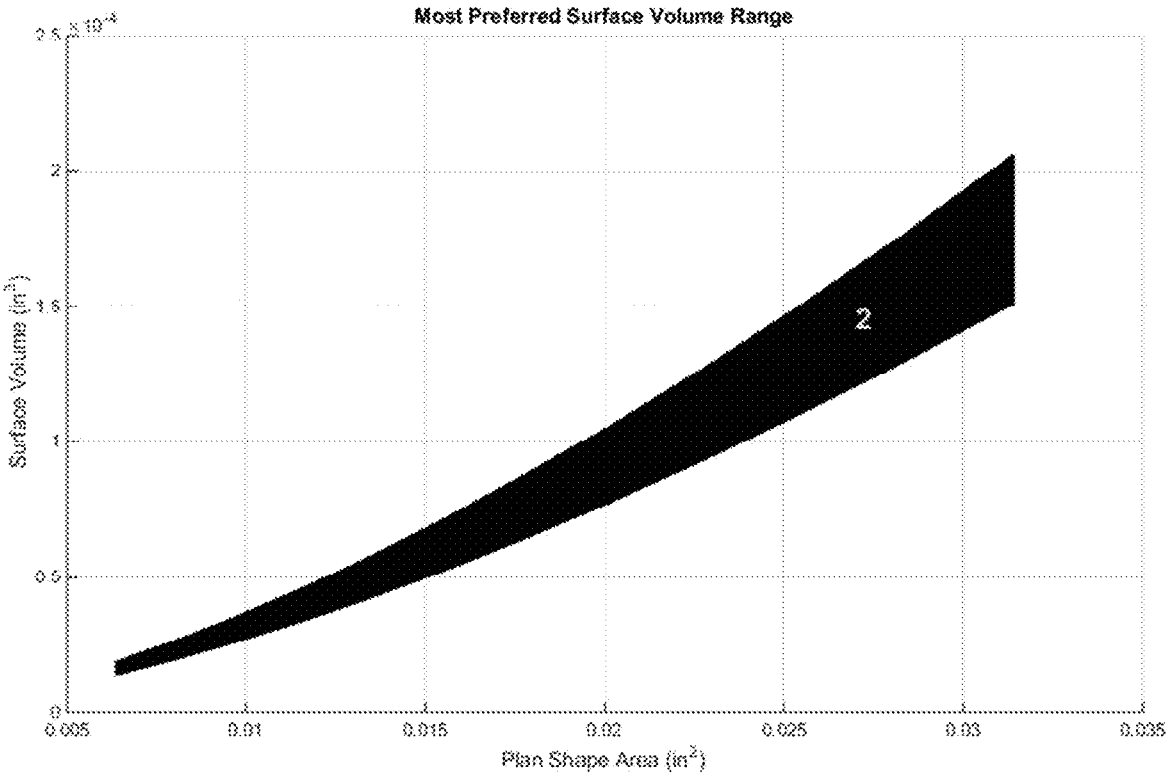
FIG. 5B is an enlarged view of shaded portion 2 of FIG. 5A.

The intersection of the prismatic polyhedron and the sphere to define a dimple should result in a dimple wherein there is no undercut, meaning that the widest part of the dimple in any orientation coincides with the spherical outer surface. And more particularly, in golf balls of the invention the resulting dimple surface volume is the common volume between golf ball outer surface 5 and the portion of at least two prism faces intersecting outer surface 5 without including the prism's bases. In this regard, FIG. 5A is a graphical representation of dimple surface volumes contemplated over a range of plan shape areas for dimples produced in accordance with the present invention. The plan shape area of dimples of the present invention is based on a planar view of the dimple plan shape such that the viewing direction is normal to an axis connecting the center of the ball to the centroid of the dimple volume. In a particular embodiment, dimples produced in accordance with the present invention have a plan shape area and dimple surface volume within a range having a lower limit and an upper limit selected from the values within shaded area 1 of FIG. 5A. In another embodiment, dimples produced in accordance with the present invention have a plan shape area and dimple surface volume within a range having a lower limit and an upper limit selected from the values within shaded area 2 of FIGS. 5A and 5B. (FIG. 5B represents an enlarged depiction of shaded area 2 of FIG. 5A).

And while only a portion of the prism's total volume V actually forms/creates the dimple perimeter and surface contour, total volume V itself nevertheless contributes to the dimple's novel construction by limiting the possible side face and edge measurements to those which collectively produce total volume V.

Dimple Patterns & Packing

Numerous dimple patterns are envisioned incorporating one or more dimples of the invention to target enhanced aesthetics and unique aerodynamic properties. In a particular embodiment, each dimple having a perimeter and a surface shape defined in accordance with the present invention is part of an overall dimple pattern that maximizes surface coverage uniformity and packing efficiency.

Thus, in one embodiment, the dimple pattern provides for overall dimple coverage of 70% or greater. In another embodiment, the dimple pattern provides for overall dimple coverage of 75% or greater. In yet another embodiment, the dimple pattern provides for overall dimple coverage of 80% or greater. In still another embodiment, the dimple pattern provides for overall dimple coverage of 85% or greater. Embodiments are also envisioned wherein the dimple pattern provides for overall dimple coverage of at least 90%, or even 95% or greater.

While dimples having a perimeter and a surface shape defined in accordance with the present invention may be used for at least a portion of the dimples on a golf ball, it is not necessary that such dimple perimeter and surface shapes be used on every dimple of a golf ball. In general, it is preferred that a sufficient number of dimples on the ball have a perimeter and a surface shape defined according to the present invention so that the aerodynamic characteristics of the ball may be altered and the unique aesthetics realized. Thus, in one embodiment, 30% or greater of the dimples on a golf ball include a perimeter and a surface shape according to the present invention. In another embodiment, 50% or greater of the dimples on a golf ball include a perimeter and a surface shape according to the present invention. In another embodiment, 70% or greater of the dimples on a golf ball include a perimeter and a surface shape according to the present invention. In another embodiment, 90% or greater of the dimples on a golf ball include a perimeter and a surface shape according to the present invention. In another embodiment, 95% or greater of the dimples on a golf ball include a perimeter and a surface shape according to the present invention. In another embodiment, 99% or greater of the dimples on a golf ball include a perimeter and a surface shape according to the present invention. In another embodiment, 100% of the dimples on a golf ball include a perimeter and a surface shape according to the present invention.

Additionally, it is envisioned that each individual dimple may be created using a single prismatic polyhedron or multiple prismatic polyhedrons. In the former embodiments, a given dimple has a dimple perimeter defined by a curve of intersection resulting from the intersection of the single prism with the spherical surface of the golf ball; and a surface shape that is defined by the portion of the prismatic outer surface of that single prism that intersects with the spherical surface of the golf ball.

In latter embodiments, a given dimple will have a dimple perimeter defined by a curve of intersection resulting from the intersection of multiple prisms with the spherical surface of the golf ball; and a surface shape that is defined by the portion of the prismatic outer surface of those multiple prisms that intersect the golf ball outer surface in a predetermined sub-pattern. In embodiment wherein multiple prisms create a single dimple, the multiple prisms may be the same, or may differ; and may be provided on the golf ball outer surface in tandem or may overlap with each other at least in part.

While the present invention is not limited by any particular dimple pattern, in one embodiment, dimples having a perimeter and a surface shape defined according to the present invention are arranged along parting lines or equatorial lines, in proximity to the poles, or along the outlines of a geodesic or polyhedron pattern, and dimples that do not have a perimeter and a surface shape defined according to the present invention occupy the remaining spaces. In another embodiment, dimples that do not have a perimeter and a surface shape defined according to the present invention are arranged along parting lines or equatorial lines, in proximity to the poles, or along the outlines of a geodesic or polyhedron pattern, and dimples that have a perimeter and a surface shape defined according to the present invention occupy the remaining spaces. Suitable dimple patterns include, but are not limited to, polyhedron-based patterns (e.g., icosahedron, octahedron, dodecahedron, tetrahedron, icosidodecahedron, cuboctahedron, and triangular dipyramid), phyllotaxis-based patterns, spherical tiling patterns, and random arrangements.

Golf Ball Construction

The dimples of the present invention may be used with practically any type of ball construction. For instance, the golf ball may have a two-piece design, a double cover, or veneer cover construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

When numerical lower limits and numerical upper limits are set forth herein, it is contemplated that any combination of these values may be used.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having a generally spherical surface and comprising a plurality of dimples on the spherical surface, including at least one dimple having:

a dimple perimeter defined by a curve of intersection resulting from the intersection of a prism with the spherical surface of the golf ball; and a surface shape defined by the portion of the prismatic outer surface that intersects with the spherical surface of the golf ball;

wherein the prismatic outer surface includes two parallel and congruent n-sided polygonal bases and at least three side faces, wherein each side face is adjacent to two other side faces and is adjoined to one side of each polygonal base; and wherein the portion of the prismatic outer surface that intersects with the spherical surface of the golf ball includes at least two adjacent side faces and does not include any portion of the polygonal bases.

2. The golf ball of claim 1, wherein the dimple perimeter is not axially symmetric when viewed in the direction normal to an axis connecting the center of the ball to the centroid of the dimple.

3. The golf ball of claim 1, wherein the prism is a regular prism.

4. The golf ball of claim 1, wherein the prism is an irregular prism.

5. The golf ball of claim 1, wherein the prism is a right prism.

6. The golf ball of claim 1, wherein the prism is an oblique prism.

7. The golf ball of claim 1, wherein each of the two polygonal bases has ten or fewer sides.

8. The golf ball of claim 1, wherein the at least one dimple has a surface depth SD of no greater than 0.020 inches.

9. The golf ball of claim 1, wherein a distance $L_E$ between two points at which the prism and the sphere intersect is from 0.050 inches to 0.400 inches.

10. The golf ball of claim 1, wherein each dimple of the portion has a plan shape area within a range having a lower limit of about 0.002 in.$^2$ and an upper limit of about 0.045 in.$^2$; and a dimple surface volume within a range having a lower limit of about $0.1^{\times 10-4}$ in.$^3$ and an upper limit of about $4.3^{\times 10-4}$ in.$^3$.

11. The golf ball of claim 10, wherein each dimple of the portion has a plan shape area within a range having a lower limit of from about 0.006 in.$^2$ and an upper limit of about 0.032 in.$^2$; and a dimple surface volume within a range having a lower limit of about $0.2^{\times 10-4}$ in.$^3$ and an upper limit of about $2.1^{\times 10-4}$ in.$^3$.

* * * * *